US011078775B2

(12) United States Patent
Romer et al.

(10) Patent No.: US 11,078,775 B2
(45) Date of Patent: Aug. 3, 2021

(54) ACOUSTIC PRESSURE WAVE GAS LIFT DIAGNOSTICS

(71) Applicant: ExxonMobil Upstream Research Company, Spring, TX (US)

(72) Inventors: Michael C. Romer, The Woodlands, TX (US); Tony W. Hord, Spring, TX (US)

(73) Assignee: ExxonMobil Upstream Research Company, Spring, TX (US)

( * ) Notice: Subject to any disclaimer, the term of this patent is extended or adjusted under 35 U.S.C. 154(b) by 43 days.

(21) Appl. No.: 16/582,237

(22) Filed: Sep. 25, 2019

(65) Prior Publication Data

US 2020/0190964 A1 Jun. 18, 2020

Related U.S. Application Data

(60) Provisional application No. 62/781,198, filed on Dec. 18, 2018.

(51) Int. Cl.
*E21B 47/008* (2012.01)
*E21B 47/06* (2012.01)
(Continued)

(52) U.S. Cl.
CPC ..... *E21B 47/008* (2020.05); *E21B 43/123* (2013.01); *E21B 47/06* (2013.01); *E21B 47/09* (2013.01)

(58) Field of Classification Search
CPC ..... E21B 47/06; E21B 47/09; E21B 47/008; E21B 43/122; E21B 43/123
See application file for complete search history.

(56) References Cited

U.S. PATENT DOCUMENTS 4,972,704 A * 11/1990 Wellington ..... E21B 49/087 73/152.18
5,458,200 A * 10/1995 Lagerlef ..... E21B 43/122 166/372

(Continued)

FOREIGN PATENT DOCUMENTS

EP 2 077 374 A1 7/2009
GB 2 393 747 A 4/2004

(Continued)

*Primary Examiner* — David Carroll
(74) *Attorney, Agent, or Firm* — ExxonMobil Upstream Research Company - Law Department

(57) ABSTRACT

A method of identifying and diagnosing open gas lift valves in a gas lift production well, the gas lift production well including a production tubular having a plurality of mechanical gas lift valves, and a casing surrounding a portion of the tubular to form an annulus. The method includes reducing injection pressure below the minimum design opening pressure of each of the plurality of mechanical gas lift valves to close each of the plurality of mechanical gas lift valves; incrementally increasing injection pressure to operating or designed injection pressure to sequentially open one or more of the plurality of mechanical gas lift valves; measuring pressure, amplitude, frequency and/or wave patterns produced by the sequential opening of the one or more mechanical gas lift valves; and determining the location of the one or more mechanical gas lift valve locations.

15 Claims, 2 Drawing Sheets

(51) Int. Cl.
*E21B 47/09* (2012.01)
*E21B 43/12* (2006.01)

(56) References Cited

U.S. PATENT DOCUMENTS

| | | | | |
|---|---|---|---|---|
| 6,328,102 | B1 | 12/2001 | Dean | |
| 6,591,201 | B1 | 7/2003 | Hyde et al. | |
| 6,662,875 | B2 * | 12/2003 | Bass | E21B 43/122 166/369 |
| 7,111,675 | B2 | 9/2006 | Zisk, Jr. | |
| 7,322,803 | B2 | 1/2008 | Vogeley | |
| 7,484,940 | B2 | 2/2009 | O'Niell | |
| 7,597,150 | B2 | 10/2009 | Clem | |
| 8,133,041 | B2 | 3/2012 | Ludlow et al. | |
| 8,220,533 | B2 | 7/2012 | Longfield et al. | |
| 8,511,390 | B2 | 8/2013 | Coyle et al. | |
| 9,863,222 | B2 | 1/2018 | Morrow et al. | |
| 2002/0197174 | A1 | 12/2002 | Howard | |
| 2003/0010491 | A1 | 1/2003 | Collette | |
| 2006/0198742 | A1 | 9/2006 | DiFoggio et al. | |
| 2008/0080991 | A1 | 4/2008 | Yuratich et al. | |
| 2009/0183879 | A1 | 7/2009 | Cox | |
| 2009/0218091 | A1 | 9/2009 | Dotson | |
| 2010/0012313 | A1 | 1/2010 | Longfield | |
| 2012/0023606 | A1 | 1/2012 | Rehman | |
| 2014/0094974 | A1 * | 4/2014 | Rashid | G05D 7/0682 700/282 |

FOREIGN PATENT DOCUMENTS

| | | | |
|---|---|---|---|
| GB | 2 403 752 | A | 1/2005 |
| WO | WO 01/20126 | A2 | 3/2001 |
| WO | WO 2009/077714 | | 6/2009 |
| WO | WO 2011/079218 | A2 | 6/2011 |

* cited by examiner

ACOUSTIC PRESSURE WAVE GAS LIFT DIAGNOSTICS

CROSS-REFERENCE TO RELATED APPLICATION

This application claims the benefit of U.S. Provisional Application 62/781,198 filed Dec. 18, 2018 entitled "Acoustic Pressure Wave Gas Lift Diagnostics," the entirety of which is incorporated by reference herein.

FIELD

The present disclosure relates to systems and methods for gas lift diagnostics.

BACKGROUND

The term "artificial lift" describes a variety of methods used to transport produced fluids to the surface when reservoir pressure alone cannot. Gas lift is a method that is particularly suited to high-volume offshore wells. A high-pressure gas, up to several thousand psi, is injected into the tubing through a casing annulus and travels to a gas lift valve. The operating valve provides a pathway for a designed volume of gas to enter the production tubing. The gas reduces the density of the fluid column, decreasing backpressure on the producing formation. The reservoir pressure available can then force more fluid to the surface. As such, gas lift valves are effectively pressure regulators and are typically installed during well completion. Multiple gas lift valves may be required to unload completion fluid from the annulus so that injected gas can reach the operating valve.

Gas lift has proven effective and gas lift wells exhibit low maintenance characteristics. However, one issue is that gas lift wells still tend to work even when they are not optimized. Such wells will typically still flow, albeit at a reduced production rate, even if they are receiving too much, or too little, gas lift gas and/or are lifting from multiple valves or a valve shallower than the desired operating point. Field diagnostics and modeling have estimated that less than 25% of gas lift wells are truly optimized.

A relatively recent commercially available gas lift diagnostic technique employs the use of CO2 tracing. A liquid slug of CO2 (or another tracer) is injected into the gas lift gas and then detected when the slug returns to the surface, through the use of a gas chromatograph. The gas and liquid injection/production transit times are calculated and used to determine which valves are passing gas. This information is then used to determine whether the well is lifting from an optimal depth and/or whether any valves require replacement.

A drawback of CO2 tracing is that the measurement equipment is bulky and multiple CO2 and N2 bottles are required for tracing and pressurization, making logistics difficult, especially in remote areas. Deep wells, or wells with small gas lift injection volumes can take hours to diagnose. Uncertainty in the gas-lift injection rate can cloud results. Additionally, an upper valve can take most of the injected slug, masking lower valves. The information this technology provides is valuable, but improved methods and systems for obtaining the information would be desirable.

Therefore, what is needed are improved systems and methods for identifying and diagnosing open gas lift valves in a gas lift production well.

SUMMARY

In one aspect, disclosed herein is a method of identifying and diagnosing open gas lift valves in a gas lift production well, the gas lift production well including a production tubular having a plurality of mechanical gas lift valves spaced along at least a portion thereof, each of the plurality of mechanical gas lift valves set to a different opening pressure, and a casing surrounding at least a portion of the tubular to form an annulus, the annulus in fluid communication with the interior of the tubular upon the opening of one or more of the mechanical gas lift valves. The method includes reducing injection pressure below the minimum design opening pressure of each of the plurality of mechanical gas lift valves to close each of the plurality of mechanical gas lift valves; incrementally increasing injection pressure to operating or designed injection pressure to sequentially open one or more of the plurality of mechanical gas lift valves; measuring pressure, amplitude, frequency and/or wave patterns produced by the sequential opening of the one or more mechanical gas lift valves; and determining the location of the one or more mechanical gas lift valves from the measured pressure, amplitude, frequency and/or wave patterns.

In some embodiments, the method includes the step of forming a data set comprising the measured pressure, amplitude, frequency and/or wave patterns and mechanical gas lift valve locations.

In some embodiments, the method includes the step of monitoring mechanical gas lift valve pressure, amplitude, frequency and/or wave patterns during production conditions and comparing the information obtained therefrom to the data set to assess and diagnose operating conditions.

In some embodiments, a first pressure sensor measures the pressure, amplitude, frequency and/or wave patterns produced by the sequential opening of the plurality of mechanical gas lift valves.

In some embodiments, the data obtained from the first pressure sensor are used to determine the location of an opened mechanical gas lift valve.

In some embodiments, a second pressure sensor simultaneously measures the pressure, amplitude, frequency and/or wave patterns produced by the sequential opening of the plurality of mechanical gas lift valves.

In some embodiments, the data obtained from the first and second pressure sensors are used to determine the location of an open mechanical gas lift valve.

In some embodiments, the first pressure sensor is placed at or near the wellhead of the gas lift production well.

In some embodiments, the first pressure sensor is placed at or near the injection header of the gas lift production well.

In some embodiments, the first pressure sensor is placed at or near the gas lift injection line of the gas lift production well.

In yet another aspect, disclosed herein is a system for identifying and diagnosing open gas lift valves in a gas lift production well, the gas lift production well including a production tubular having a plurality of mechanical gas lift valves spaced along at least a portion thereof, each of the plurality of mechanical gas lift valves set to a different opening pressure, and a casing surrounding at least a portion of the tubular to form an annulus, the annulus in fluid communication with the interior of the tubular upon the opening of one or more of the mechanical gas lift valves. The system includes a first pressure sensor for monitoring pressure, amplitude, frequency and/or wave patterns produced by the opening of one or more of the mechanical gas lift valves; and a data acquisition system for monitoring, collecting, and analyzing pressure, amplitude, frequency and/or wave patterns produced by the opening of one or more of the mechanical gas lift valves.

In some embodiments, the system includes a second pressure sensor for monitoring pressure, amplitude, frequency and/or wave patterns produced by the opening of one or more of the mechanical gas lift valves, the second pressure sensor positioned in a spaced-apart relationship from the first pressure sensor.

In some embodiments, the first pressure sensor and/or the second pressure are high-resolution, high-frequency, dynamic pressure sensors.

In some embodiments, the first pressure sensor is placed at or near the wellhead of the gas lift production well.

In some embodiments, the first pressure sensor is placed at or near the injection header of the gas lift production well.

In some embodiments, the first pressure sensor is placed at or near the gas lift injection line of the gas lift production well.

In some embodiments, the production tubular and the casing are hydraulically isolated from one another when the plurality of mechanical gas lift valves are in the closed position.

In some embodiments, the gas lift production well includes at least one packer positioned downstream of the plurality of mechanical gas lift valves to hydraulically isolate production tubular and the casing.

In some embodiments, the system includes pressure wave analysis tools, the pressure wave analysis tools residing on a portable computing device.

In some embodiments, the data acquisition system resides on the portable computing system.

In some embodiments, the pressure wave analysis tools identify injection point depths.

In some embodiments, the monitoring and analysis tools monitor and compare injection characteristics among a plurality of injection points.

In some embodiments, the injection characteristics compared comprises an initial pressure disturbance produced by a leak.

In some embodiments, the plurality of mechanical gas lift valves are automated valves for selectively activating gas injection points.

BRIEF DESCRIPTION OF THE DRAWINGS

The present disclosure is susceptible to various modifications and alternative forms, specific exemplary implementations thereof have been shown in the drawings and are herein described in detail. It should be understood, however, that the description herein of specific exemplary implementations is not intended to limit the disclosure to the particular forms disclosed herein. This disclosure is to cover all modifications and equivalents as defined by the appended claims. It should also be understood that the drawings are not necessarily to scale, emphasis instead being placed upon clearly illustrating principles of exemplary embodiments of the present invention. Moreover, certain dimensions may be exaggerated to help visually convey such principles. Further where considered appropriate, reference numerals may be repeated among the drawings to indicate corresponding or analogous elements. Moreover, two or more blocks or elements depicted as distinct or separate in the drawings may be combined into a single functional block or element. Similarly, a single block or element illustrated in the drawings may be implemented as multiple steps or by multiple elements in cooperation. The forms disclosed herein are illustrated by way of example, and not by way of limitation, in the figures of the accompanying drawings and in which like reference numerals refer to similar elements and in which:

DETAILED DESCRIPTION

Terminology

Figure 1:
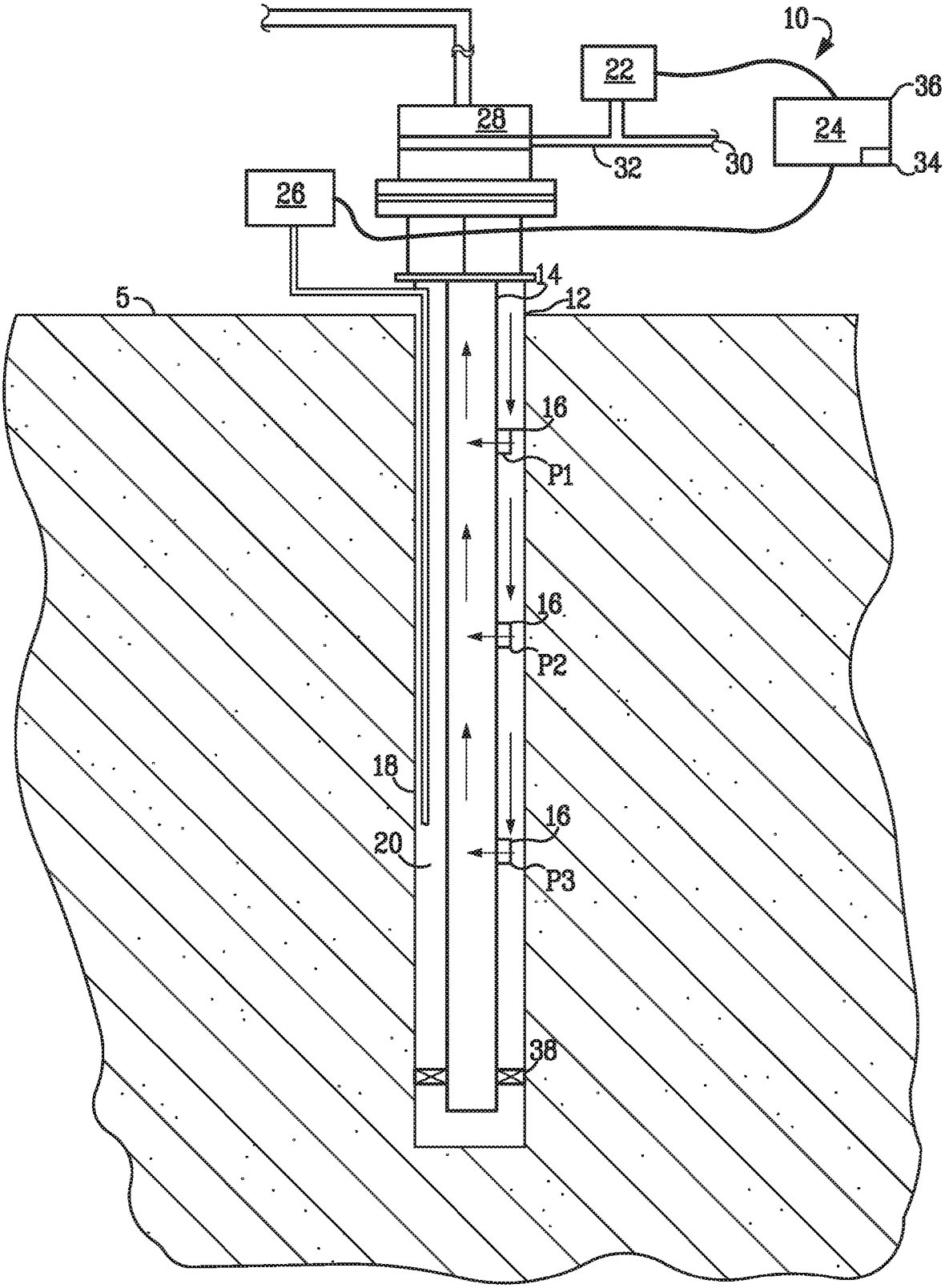
FIG. 1 is a schematic representation of an illustrative, non-exclusive example of a system for identifying and diagnosing open gas lift valves in a gas lift production well, according to the present disclosure.

The words and phrases used herein should be understood and interpreted to have a meaning consistent with the understanding of those words and phrases by those skilled in the relevant art. No special definition of a term or phrase, i.e., a definition that is different from the ordinary and customary meaning as understood by those skilled in the art, is intended to be implied by consistent usage of the term or phrase herein. To the extent that a term or phrase is intended to have a special meaning, i.e., a meaning other than the broadest meaning understood by skilled artisans, such a special or clarifying definition will be expressly set forth in the specification in a definitional manner that provides the special or clarifying definition for the term or phrase.

For example, the following discussion contains a non-exhaustive list of definitions of several specific terms used in this disclosure (other terms may be defined or clarified in a definitional manner elsewhere herein). These definitions are intended to clarify the meanings of the terms used herein. It is believed that the terms are used in a manner consistent with their ordinary meaning, but the definitions are nonetheless specified here for clarity.

A/an: The articles "a" and "an" as used herein mean one or more when applied to any feature in embodiments and implementations of the present invention described in the specification and claims. The use of "a" and "an" does not limit the meaning to a single feature unless such a limit is specifically stated. The term "a" or "an" entity refers to one or more of that entity. As such, the terms "a" (or "an"), "one or more" and "at least one" can be used interchangeably herein.

About: As used herein, "about" refers to a degree of deviation based on experimental error typical for the particular property identified. The latitude provided the term "about" will depend on the specific context and particular property and can be readily discerned by those skilled in the art. The term "about" is not intended to either expand or limit the degree of equivalents which may otherwise be afforded a particular value. Further, unless otherwise stated, the term "about" shall expressly include "exactly," consistent with the discussion below regarding ranges and numerical data.

Above/below: In the following description of the representative embodiments of the invention, directional terms, such as "above", "below", "upper", "lower", etc., are used for convenience in referring to the accompanying drawings. In general, "above", "upper", "upward" and similar terms refer to a direction toward the earth's surface along a wellbore, and "below", "lower", "downward" and similar terms refer to a direction away from the earth's surface along the wellbore. Continuing with the example of relative directions in a wellbore, "upper" and "lower" may also refer to relative positions along the longitudinal dimension of a wellbore rather than relative to the surface, such as in describing both vertical and horizontal wells.

And/or: The term "and/or" placed between a first entity and a second entity means one of (1) the first entity, (2) the second entity, and (3) the first entity and the second entity. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements). As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of".

Any: The adjective "any" means one, some, or all indiscriminately of whatever quantity.

At least: As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements). The phrases "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

Based on: "Based on" does not mean "based only on", unless expressly specified otherwise. In other words, the phrase "based on" describes both "based only on," "based at least on," and "based at least in part on."

Comprising: In the claims, as well as in the specification, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

Couple: Any use of any form of the terms "connect", "engage", "couple", "attach", or any other term describing an interaction between elements is not meant to limit the interaction to direct interaction between the elements and may also include indirect interaction between the elements described.

Determining: "Determining" encompasses a wide variety of actions and therefore "determining" can include calculating, computing, processing, deriving, investigating, looking up (e.g., looking up in a table, a database or another data structure), ascertaining and the like. Also, "determining" can include receiving (e.g., receiving information), accessing (e.g., accessing data in a memory) and the like. Also, "determining" can include resolving, selecting, choosing, establishing and the like.

Embodiments: Reference throughout the specification to "one embodiment," "an embodiment," "some embodiments," "one aspect," "an aspect," "some aspects," "some implementations," "one implementation," "an implementation," or similar construction means that a particular component, feature, structure, method, or characteristic described in connection with the embodiment, aspect, or implementation is included in at least one embodiment and/or implementation of the claimed subject matter. Thus, the appearance of the phrases "in one embodiment" or "in an embodiment" or "in some embodiments" (or "aspects" or "implementations") in various places throughout the specification are not necessarily all referring to the same embodiment and/or implementation. Furthermore, the particular features, structures, methods, or characteristics may be combined in any suitable manner in one or more embodiments or implementations.

Exemplary: "Exemplary" is used exclusively herein to mean "serving as an example, instance, or illustration." Any embodiment described herein as "exemplary" is not necessarily to be construed as preferred or advantageous over other embodiments.

Flow diagram: Exemplary methods may be better appreciated with reference to flow diagrams or flow charts. While for purposes of simplicity of explanation, the illustrated methods are shown and described as a series of blocks, it is to be appreciated that the methods are not limited by the order of the blocks, as in different embodiments some blocks may occur in different orders and/or concurrently with other blocks from that shown and described. Moreover, less than all the illustrated blocks may be required to implement an exemplary method. In some examples, blocks may be combined, may be separated into multiple components, may employ additional blocks, and so on. In some examples, blocks may be implemented in logic. In other examples, processing blocks may represent functions and/or actions performed by functionally equivalent circuits (e.g., an analog circuit, a digital signal processor circuit, an application specific integrated circuit (ASIC)), or other logic device. Blocks may represent executable instructions that cause a computer, processor, and/or logic device to respond, to perform an action(s), to change states, and/or to make decisions. While the figures illustrate various actions occurring in serial, it is to be appreciated that in some examples various actions could occur concurrently, substantially in series, and/or at substantially different points in time. In some examples, methods may be implemented as processor executable instructions. Thus, a machine-readable medium may store processor executable instructions that if executed by a machine (e.g., processor) cause the machine to perform a method.

May: Note that the word "may" is used throughout this application in a permissive sense (i.e., having the potential to, being able to), not a mandatory sense (i.e., must).

Operatively connected and/or coupled: Operatively connected and/or coupled means directly or indirectly connected for transmitting or conducting information, force, energy, or matter.

Optimizing: The terms "optimal," "optimizing," "optimize," "optimality," "optimization" (as well as derivatives and other forms of those terms and linguistically related words and phrases), as used herein, are not intended to be limiting in the sense of requiring the present invention to find the best solution or to make the best decision. Although a mathematically optimal solution may in fact arrive at the best of all mathematically available possibilities, real-world embodiments of optimization routines, methods, models, and processes may work towards such a goal without ever actually achieving perfection.

Accordingly, one of ordinary skill in the art having benefit of the present disclosure will appreciate that these terms, in the context of the scope of the present invention, are more general. The terms may describe one or more of: 1) working towards a solution which may be the best available solution, a preferred solution, or a solution that offers a specific benefit within a range of constraints; 2) continually improving; 3) refining; 4) searching for a high point or a maximum for an objective; 5) processing to reduce a penalty function; 6) seeking to maximize one or more factors in light of competing and/or cooperative interests in maximizing, minimizing, or otherwise controlling one or more other factors, etc.

Order of steps: It should also be understood that, unless clearly indicated to the contrary, in any methods claimed herein that include more than one step or act, the order of the steps or acts of the method is not necessarily limited to the order in which the steps or acts of the method are recited.

Ranges: Concentrations, dimensions, amounts, and other numerical data may be presented herein in a range format. It is to be understood that such range format is used merely for convenience and brevity and should be interpreted flexibly to include not only the numerical values explicitly recited as the limits of the range, but also to include all the individual numerical values or sub-ranges encompassed within that range as if each numerical value and sub-range is explicitly recited. For example, a range of about 1 to about 200 should be interpreted to include not only the explicitly recited limits of 1 and about 200, but also to include individual sizes such as 2, 3, 4, etc. and sub-ranges such as 10 to 50, 20 to 100, etc. Similarly, it should be understood that when numerical ranges are provided, such ranges are to be construed as providing literal support for claim limitations that only recite the lower value of the range as well as claims limitation that only recite the upper value of the range. For example, a disclosed numerical range of 10 to 100 provides literal support for a claim reciting "greater than 10" (with no upper bounds) and a claim reciting "less than 100" (with no lower bounds).

As used herein, the term "formation" refers to any definable subsurface region. The formation may contain one or more hydrocarbon-containing layers, one or more non-hydrocarbon containing layers, an overburden, and/or an underburden of any geologic formation.

As used herein, the term "hydrocarbon" refers to an organic compound that includes primarily, if not exclusively, the elements hydrogen and carbon. Examples of hydrocarbons include any form of natural gas, oil, coal, and bitumen that can be used as a fuel or upgraded into a fuel.

As used herein, the term "hydrocarbon fluids" refers to a hydrocarbon or mixtures of hydrocarbons that are gases or liquids. For example, hydrocarbon fluids may include a hydrocarbon or mixtures of hydrocarbons that are gases or liquids at formation conditions, at processing conditions, or at ambient conditions (20° C. and 1 atm pressure). Hydrocarbon fluids may include, for example, oil, natural gas, gas condensates, coal bed methane, shale oil, shale gas, and other hydrocarbons that are in a gaseous or liquid state.

As used herein, the term "sensor" includes any electrical sensing device or gauge. The sensor may be capable of monitoring or detecting pressure, temperature, fluid flow, vibration, resistivity, or other formation data. Alternatively, the sensor may be a position sensor.

As used herein, the term "subsurface" refers to geologic strata occurring below the earth's surface.

The terms "tubular member" or "tubular body" refer to any pipe, such as a joint of casing, a portion of a liner, a drill string, a production tubing, an injection tubing, a pup joint, a buried pipeline, underwater piping, or above-ground piping, solid lines therein, and any suitable number of such structures and/or features may be omitted from a given embodiment without departing from the scope of the present disclosure.

As used herein, the term "wellbore" refers to a hole in the subsurface made by drilling or insertion of a conduit into the subsurface. A wellbore may have a substantially circular cross section, or other cross-sectional shape. As used herein, the term "well," when referring to an opening in the formation, may be used interchangeably with the term "wellbore."

The terms "zone" or "zone of interest" refer to a portion of a subsurface formation containing hydrocarbons. The term "hydrocarbon-bearing formation" may alternatively be used.

DESCRIPTION

Specific forms will now be described further by way of example. While the following examples demonstrate certain forms of the subject matter disclosed herein, they are not to be interpreted as limiting the scope thereof, but rather as contributing to a complete description.

Figure 2:
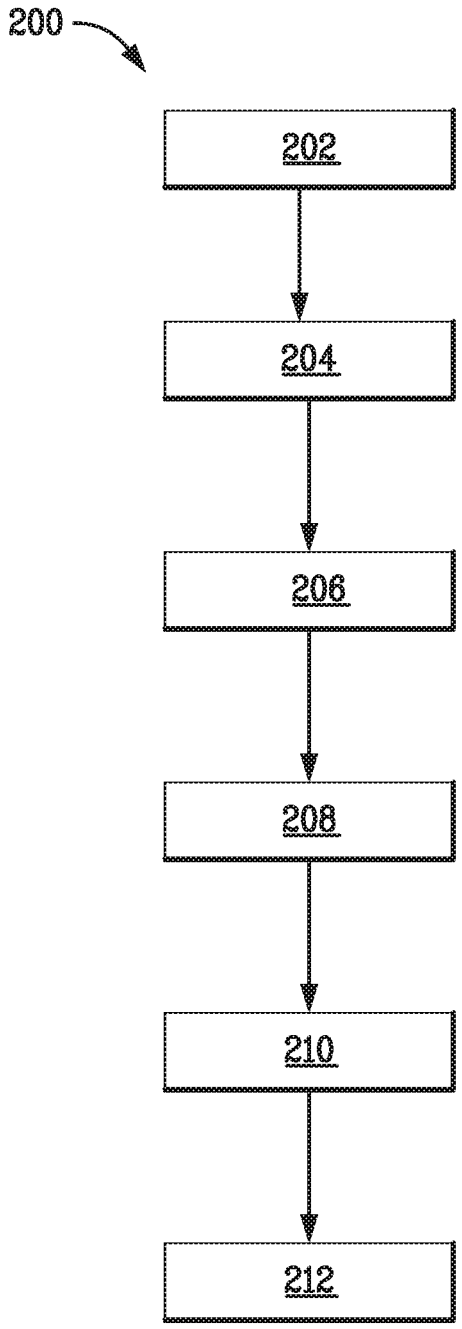
FIG. 2 is a flowchart depicting a method of identifying and diagnosing open gas lift valves in a gas lift production well, according to the present disclosure.

FIGS. 1-2 provide illustrative, non-exclusive examples of systems and methods for identifying and diagnosing open gas lift valves in a gas lift production well, according to the present disclosure, together with elements that may include, be associated with, be operatively attached to, and/or utilize such methods or systems.

In FIGS. 1-2, like numerals denote like, or similar, structures and/or features; and each of the illustrated structures and/or features may not be discussed in detail herein with reference to the figures. Similarly, each structure and/or feature may not be explicitly labeled in the figures; and any structure and/or feature that is discussed herein with reference to the figures may be utilized with any other structure and/or feature without departing from the scope of the present disclosure.

In general, structures and/or features that are, or are likely to be, included in a given embodiment are indicated in solid lines in the figures, while optional structures and/or features are indicated in broken lines. However, a given embodiment is not required to include all structures and/or features that are illustrated in solid lines therein, and any suitable number of such structures and/or features may be omitted from a given embodiment without departing from the scope of the present disclosure.

Although the approach disclosed herein can be applied to a variety of subterranean well designs and operations, the present description will primarily be directed to a fluid end pump and systems for removing fluids from a subterranean well.

Referring now to FIG. 1, a schematic representation of an illustrative, non-exclusive example of a system 10 for identifying and diagnosing open gas lift valves in a gas lift production well 12, according to the present disclosure is presented. The gas lift production well 12 includes a production tubular 14 having a plurality of mechanical gas lift valves 16 spaced along at least a portion thereof. In accordance herewith, each of the plurality of mechanical gas lift valves 16 are set to a selected, often different, opening pressure (P1, P2, P3, etc.). Opening orifice or aperture sizes may also be designed or selected for each valve.

A casing 18 surrounding at least a portion of the tubular 14 forms an annulus 20. As shown, annulus 20 is in fluid communication with the interior of the tubular 14 upon the opening of one or more of the mechanical gas lift valves 16.

System 10 includes a first pressure sensor 22 for monitoring pressure, amplitude, frequency and/or wave patterns produced by the opening of one or more of the mechanical gas lift valves 16.

System 10 also includes a data acquisition system 24 in communication with first pressure sensor 22 for monitoring, collecting, and analyzing pressure, amplitude, frequency and/or wave patterns produced by the opening of one or more of the mechanical gas lift valves 16. Data acquisition system 24 may include pressure wave analysis tools 34. Alternatively, the pressure wave analysis tools 34 and/or the data acquisition system 24 may reside on a portable computing device 36. The pressure wave analysis tools 34 are structured and arranged to identify injection point depths. The pressure wave and analysis tools 34 may be configured to monitor and compare injection characteristics among a plurality of injection points. Additionally, the injection characteristics compared may include an initial pressure disturbance produced by a leak.

In some embodiments, system 10 may include a second pressure sensor 26 for monitoring pressure, amplitude, frequency and/or wave patterns produced by the opening of one or more of the mechanical gas lift valves 16, the second pressure sensor 26 positioned in a spaced-apart relationship from the first pressure sensor 22, as shown. In some embodiments, the first pressure sensor 22 and/or the second pressure 26 are high-resolution, high-frequency, dynamic pressure sensors.

In some embodiments, the first pressure sensor 22 is placed at or near the wellhead 28 of the gas lift production well 12.

In some embodiments, the first pressure sensor 22 is placed at or near the injection header 30 of the gas lift production well 12. In some embodiments, the first pressure sensor 22 is placed at or near the gas lift injection line 32 of the gas lift production well 12.

In some embodiments, the production tubular and the casing are hydraulically isolated from one another when the plurality of mechanical gas lift valves 16 are in the closed position.

In some embodiments, the gas lift production well 12 further includes at least one packer 38 positioned downstream of the plurality of mechanical gas lift valves 16 to hydraulically isolate production tubular 14 and the casing 18.

In some embodiments, the plurality of mechanical gas lift valves 16 are automated valves for selectively activating gas injection points.

Referring now to FIG. 2, a method of identifying and diagnosing open gas lift valves in a gas lift production well 200, is presented. Referring also to FIG. 1, the gas lift production well 12 included a production tubular 14 having a plurality of mechanical gas lift valves 16 spaced along at least a portion thereof, each of the plurality of mechanical gas lift valves set to a different opening pressure (P1, P2, P3), and a casing 18 surrounding at least a portion of the tubular to form an annulus 20, the annulus 20 in fluid communication with the interior of the tubular 14 upon the opening of one or more of the mechanical gas lift valves 16.

The method 200 includes step 202, reducing injection pressure below the minimum design opening pressure of each of the plurality of mechanical gas lift valves 16 to close each of the plurality of mechanical gas lift valves 16. The method 200 also includes step 204, incrementally increasing injection pressure to operating or designed injection pressure to sequentially open one or more of the plurality of mechanical gas lift valves 16, step 206, measuring pressure, amplitude, frequency and/or wave patterns produced by the sequential opening of the one or more mechanical gas lift valves 16; and step 208, determining the location of the one or more mechanical gas lift valves from the measured pressure, amplitude, frequency and/or wave patterns.

In some embodiments, the method 200 further includes the step 210 of forming a data set comprising the measured pressure, amplitude, frequency and/or wave patterns and mechanical gas lift valve locations.

In some embodiments, the method 200 further includes the step 212 of monitoring mechanical gas lift valve pressure, amplitude, frequency and/or wave patterns during production conditions and comparing the information obtained therefrom to the data set to assess and diagnose operating conditions.

In some embodiments, the method 200 may further include the steps of: reducing injection pressure below the minimum design opening pressure of each of the plurality of mechanical gas lift valves to close each of the plurality of mechanical gas lift valves; incrementally increasing injection pressure to the design opening pressure to open one of the plurality of mechanical gas lift valves; measuring at least one of pressure, amplitude, frequency and wave patterns, and combinations thereof, produced by the opening of the one of the mechanical gas lift valves; incrementally further increasing injection pressure to the design opening pressure to open another of the plurality of mechanical gas lift valves; measuring another of at least one of pressure, amplitude, frequency and wave patterns and combinations thereof, produced by the opening of the another of the mechanical gas lift valves; determining the location of the one mechanical gas lift valve and the location of the another of the plurality of mechanical gas lift valves, from the measured at least one of the and the another at least one of, pressure, amplitude, frequency and wave patterns, and combinations thereof; and determine whether at least one of the one mechanical gas lift valve and the another mechanical gas lift valves are operating according to the selected minimum design operating pressure.

Referring a to FIG. 1, in some embodiments, a first pressure sensor 22 measures the pressure, amplitude, frequency and/or wave patterns produced by the sequential opening of the plurality of mechanical gas lift valves 16.

In some embodiments, the data obtained from the first pressure sensor 22 are used to determine the location of an opened mechanical gas lift valve 16.

In some embodiments, a second pressure sensor 26 simultaneously measures the pressure, amplitude, frequency and/or wave patterns produced by the sequential opening of the plurality of mechanical gas lift valves 16.

In some embodiments, the data obtained from the first and second pressure sensors 22 and 26 are used to determine the location of an open mechanical gas lift valve 16.

In some embodiments, the first pressure sensor 22 is placed at or near the well head 28 of the gas lift production well 12.

In some embodiments, the first pressure sensor 22 is placed at or near the injection header 30 of the gas lift production well 12.

In some embodiments, the first pressure sensor 22 is placed at or near the gas lift injection line 32 of the gas lift production well 12.

As may be appreciated, gas lift wells are commonly employed, particularly offshore. Field diagnostics and modeling have estimated that less than 25% of gas lift wells are optimized, resulting in lost production and inefficient gas allocation.

Acoustic pressure waves have been used to diagnose leaks in various pipeline applications. When a sudden leak occurs in a pipe, it creates a one-time acoustic pressure wave. This wave travels at the speed of sound through the transported medium. This phenomenon can be used to determine a leak location if high-resolution, high frequency, dynamic pressure sensors are placed at multiple locations along the pipeline. When a leak initiates, its acoustic wave travels in both directions, reaching the nearest sensors at different times. The times and distances are then compared and the leak location can be pinpointed.

In a gas lift system, the tubing by casing annulus could be treated as a dead-end pipeline, where the gas lift valves are the designed "leak paths" into the production tubing. A first pressure sensor could be placed on the gas lift gas inlet at the wellhead. A second sensor could also be placed downhole. Since the gas lift annulus is a closed system, any acoustic wave created by a "leak" would echo off its boundary. Such as the static fluid level in the annulus or the production packer. This boundary depth can be determined with known acoustic methods (such as the Echometer fluid level system, available from Echometer Co. of Wichita Falls, Tex.), which can also determine the speed of sound in the gas. With a known depth, the boundary echo could be used in lieu of a second sensor to determine the leak location.

In operation, to determine whether a well has one or more open valves, the casing or injection pressure may be reduced to the point that all gas lift valves are closed. The pressure would then be increased slowly such that the operating valves would open sequentially. As may be appreciated, gas lift valves are essentially stepped pressure regulators by design; in that they require a minimum pressure to open, and will only close once the primary pressure source is reduced below the minimum design opening pressure. Since the acoustic pressure waves occur only once per leak initiation, each new "opening" event creates an acoustic signal that is identified as a leak, and the active gas lift valve locations may be identified.

In pipeline applications, it has been found that the leak rate is proportional to the initial pressure disturbance caused by a leak. Thus, a comparison of the acoustic waves created by various gas lift valves may be used to determine a qualitative flow allocation. Repeated measurements may be used to determine whether the port in a given gas lift valve is achieving its designed throughput, is plugging, or is eroding. This system will also recognize valves that repeatedly open and close ("chatter"), such that operating conditions could be modified to avoid further valve damage.

The described measurement system could be a portable tool or permanently placed. A pressure sweep may be employed as an automated, scheduled diagnostic test, with a permanent system for determining the condition of a well's gas lift valves.

The described acoustic wave diagnostic system and methods would eliminate the need for pressurized tracer bottles. The long wait time for a slug to travel down the annulus to a gas lift valve, estimated at 95% of total round-trip time in CO2 tracing, is avoided, as the measurement time is dependent on the speed of sound. Multiple tests could be performed in a short time to verify results. An accurate knowledge of the gas lift gas injection rate is unnecessary since the injection pressure is the primary variable measured. A multiphase outflow model for the production tubing would be unnecessary since the tubing is outside of the measurement volume's boundaries. Finally, an upper valve would not be able to monopolize test results, as each valve would create its own leak profile.

Illustrative, non-exclusive examples of assemblies, systems and methods according to the present disclosure have been presented. It is within the scope of the present disclosure that an individual step of a method recited herein, including in the following enumerated paragraphs, may additionally or alternatively be referred to as a "step for" performing the recited action.

INDUSTRIAL APPLICABILITY

The apparatus and methods disclosed herein are applicable to the oil and gas industry.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to one of the disclosed inventions and are novel and non-obvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower, or equal in scope to the original claims, are also regarded as included within the subject matter of the inventions of the present disclosure.

While the present invention has been described and illustrated by reference to particular embodiments, those of ordinary skill in the art will appreciate that the invention lends itself to variations not necessarily illustrated herein. For this reason, then, reference should be made solely to the appended claims for purposes of determining the true scope of the present invention.

What is claimed is:

1. A method of identifying and diagnosing open gas lift valves in a gas lift production well, the gas lift production well including a production tubular having a plurality of mechanical gas lift valves spaced along at least a portion thereof, each of the plurality of mechanical gas lift valves set to a selected minimum design opening pressure, and a casing surrounding at least a portion of the tubular to form an annulus, the annulus in fluid communication with the interior of the tubular upon the opening of one or more of the mechanical gas lift valves, the method comprising:

reducing injection pressure below the minimum design opening pressure of each of the plurality of mechanical gas lift valves to close each of the plurality of mechanical gas lift valves;

incrementally increasing injection pressure to the design opening pressure to open one of the plurality of mechanical gas lift valves;

measuring at least one of pressure, amplitude, frequency and wave patterns, and combinations thereof, produced by the opening of the one of the mechanical gas lift valves;

incrementally further increasing injection pressure to the design opening pressure to open another of the plurality of mechanical gas lift valves;

measuring another of at least one of pressure, amplitude, frequency and wave patterns and combinations thereof, produced by the opening of the another of the mechanical gas lift valves;

determining the location of the one mechanical gas lift valve and the location of the another of the plurality of mechanical gas lift valves, from the measured at least one of the and the another at least one of, pressure, amplitude, frequency and wave patterns, and combinations thereof, wherein the location of the one mechanical gas lift valve and the location of the another of the plurality of mechanical gas lift valves are determined based on travel times of the at least one of pressure, amplitude, frequency and wave patterns that travel in both directions from the one mechanical gas lift valve and the another of the mechanical gas lift valves; and determining whether at least one of the one mechanical gas lift valve and the another mechanical gas lift valves are operating according to the selected minimum design operating pressure.

2. The method of claim 1, further comprising the step of forming a data set comprising the measured pressure, amplitude, frequency and/or wave patterns and mechanical gas lift valve locations.

3. The method of claim 2, further comprising the step of monitoring mechanical gas lift valve pressure, amplitude, frequency and/or wave patterns during production conditions and comparing the information obtained therefrom to the data set to assess and diagnose operating conditions.

4. The method of claim 1, wherein a first pressure sensor measures the pressure, amplitude, frequency and/or wave patterns produced by the sequential opening of the plurality of mechanical gas lift valves.

5. The method of claim 4, wherein data obtained from the first pressure sensor are used to determine the location of an opened mechanical gas lift valve.

6. The method of claim 4, wherein a second pressure sensor simultaneously measures the pressure, amplitude, frequency and/or wave patterns produced by the sequential opening of the plurality of mechanical gas lift valves.

7. The method of claim 6, wherein data obtained from the first and second pressure sensors are used to determine the location of an open mechanical gas lift valve.

8. The method of claim 4, wherein the first pressure sensor is placed at the wellhead of the gas lift production well.

9. The method of claim 4, wherein the first pressure sensor is placed at the injection header of the gas lift production well.

10. The method of claim 4, wherein the first pressure sensor is placed at the gas lift injection line of the gas lift production well.

11. A system for identifying and diagnosing open gas lift valves in a gas lift production well, the gas lift production well including a production tubular having a plurality of mechanical gas lift valves spaced along at least a portion thereof, each of the plurality of mechanical gas lift valves set to a different opening pressure, and a casing surrounding at least a portion of the tubular to form an annulus, the annulus in fluid communication with the interior of the tubular upon the opening of one or more of the mechanical gas lift valves, comprising:

a first pressure sensor for monitoring pressure, amplitude, frequency and/or wave patterns produced by the opening of one or more of the mechanical gas lift valves; and a data acquisition system for monitoring, collecting, and analyzing pressure, amplitude, frequency and/or wave patterns produced by the opening of one or more of the mechanical gas lift valves, wherein the data acquisition system is configured to determine the location of one or more of the mechanical gas lift valves based on travel times of the at least one of pressure, amplitude, frequency and wave patterns that travel in both directions from the one or more of the mechanical gas lift valves.

12. The system of claim 11, further comprising a second pressure sensor for monitoring pressure, amplitude, frequency and/or wave patterns produced by the opening of one or more of the mechanical gas lift valves, the second pressure sensor positioned in a spaced-apart relationship from the first pressure sensor.

13. The system of claim 12, wherein the first pressure sensor and/or the second pressure are high-resolution, high frequency, dynamic pressure sensors.

14. The system of claim 11, further comprising pressure wave analysis tools, the pressure wave analysis tools residing on a portable computing device.

15. The system of claim 14, wherein the pressure wave analysis tools identify injection point depths.

* * * * *